US011440703B1

(12) United States Patent
Schapira et al.

(10) Patent No.: US 11,440,703 B1
(45) Date of Patent: Sep. 13, 2022

(54) BOTTLE

(71) Applicant: MSSD HOLDINGS, LLC, Lakewood, NJ (US)

(72) Inventors: Martin Schapira, Lakewood, NJ (US); Mauricio Sanin, Cali (CO)

(73) Assignee: MSSD HOLDING, LLC, Lakewood, NJ (US)

( * ) Notice: Subject to any disclaimer, the term of this patent is extended or adjusted under 35 U.S.C. 154(b) by 0 days.

(21) Appl. No.: 17/214,097

(22) Filed: Mar. 26, 2021

(51) Int. Cl.
*B65D 23/10* (2006.01)
*B65D 39/00* (2006.01)
*B65D 1/02* (2006.01)

(52) U.S. Cl.
CPC ..... *B65D 23/102* (2013.01); *B65D 1/023* (2013.01); *B65D 39/0005* (2013.01); *B65D 2501/0081* (2013.01)

(58) Field of Classification Search
CPC .. B65D 23/102; B65D 1/023; B65D 39/0005; B65D 2501/0081; B65D 23/10; B65D 2501/009; B65D 1/0223; A45F 3/18
See application file for complete search history.

(56) References Cited

U.S. PATENT DOCUMENTS 4,712,698 A * 12/1987 Greenberg ..... A47G 19/22 D7/533
D302,919 S * 8/1989 Feltman, III ..... D7/534
5,086,937 A * 2/1992 Robinson ..... B65D 23/10 215/398
5,609,175 A * 3/1997 Gerry ..... A45B 9/02 135/25.4
6,913,159 B1 * 7/2005 Goldberg ..... B65D 23/106 215/396
D668,962 S * 10/2012 Middleton ..... D9/680
D676,752 S * 2/2013 Middleton ..... D9/680
D740,674 S * 10/2015 Rigsbee ..... D9/533
D769,674 S * 10/2016 Goode ..... D7/529
9,468,341 B1 * 10/2016 Goode ..... A47J 43/27
D943,415 S * 2/2022 Holmes ..... D9/439
2010/0043917 A1 * 2/2010 Kitchener ..... F25D 23/12 141/65
2011/0073557 A1 * 3/2011 Lin ..... B65D 39/0052 215/355
2011/0108511 A1 * 5/2011 McKinney ..... B65D 39/0017 215/355
2012/0152955 A1 * 6/2012 Middleton ..... B65D 81/366 220/288
2013/0008914 A1 * 1/2013 Dyer ..... B65D 23/102 215/398

(Continued)

*Primary Examiner* — Don M Anderson
(74) *Attorney, Agent, or Firm* — Law Offices of Alozie N. Etufugh, PLLC

(57) ABSTRACT

A bottle having functional elements is disclosed. The bottle includes a neck, which includes a rim with an opening to a void, a handle, which includes cylindrical aperture(s), a handle base, and an outer rim opposite the handle base. The base may be contiguous with the bottle's neck and handle's outer rim may have an undulating contour. The cylindrical aperture(s) may be located between the base and the handle's outer rim. The bottle may also include a shoulder, a body, and a stopper, where the stopper is configured to fit within the bottle rim's opening. The neck, shoulder and body all together contiguously enclose the void.

17 Claims, 7 Drawing Sheets

(56) References Cited

U.S. PATENT DOCUMENTS

| | | | | |
|---|---|---|---|---|
| 2013/0270280 | A1* | 10/2013 | De Coninck | B65D 1/0223 220/675 |
| 2015/0251810 | A1* | 9/2015 | Glaser | B65D 23/102 215/382 |
| 2017/0120273 | A1* | 5/2017 | Goldstein | B65D 21/0228 |
| 2017/0240845 | A1* | 8/2017 | Harris | B65D 23/102 |
| 2019/0075914 | A1* | 3/2019 | Teper | B65D 23/12 |

* cited by examiner

BOTTLE

FIELD OF THE INVENTION

The present invention is directed to a bottle, specifically, a bottle designed to ease the use of a bottle in serving drinks and other liquids while preventing the bottle from slipping out of a user's hand.

BACKGROUND & SUMMARY OF THE INVENTION

Bottle users may pour out the contents of a bottle, such as drinks and other liquids, by using a number of methods which may include gripping the neck of the bottle or holding onto the body of the bottle. However, some of these methods are fraught with the possibility of having the bottle slip out of a user's hands thus leading to loss of the bottle and its contents. As such, there exists a need for a bottle designed to ease the serving of drinks, liquids or bottle contents thereby enabling a user to properly handle the bottle while doing so. There is also a need for a bottle handling design that is aesthetically pleasing, sturdier and functional in securing a bottle from dropping from a user's hands when the user is pouring out a bottle's contents.

SUMMARY OF THE INVENTION

Aspects of embodiments of the present invention contemplate a bottle which may include: a neck, where the neck includes a rim with an opening to a void, and a handle. In an aspect of an embodiment of the present invention, the handle may include cylindrical aperture(s), a base, and an outer rim opposite the base, where the base may be contiguous with the neck and where the outer rim may have an undulating contour. In an aspect of an embodiment of the present invention the handle base may be perpendicular to the neck.

In an aspect of an embodiment of the present invention, the cylindrical aperture(s) may be located between the base and the outer rim. The bottle, as contemplated by an aspect of an embodiment of the present invention may also include a shoulder, where the shoulder may be contiguous with the neck, a body, where the body may be contiguous with the shoulder, and a stopper, where the stopper may be configured to fit within the rim's opening. The neck, shoulder and body together enclose the void. The void may be the enclosure within which liquids may be received, stored and poured from the bottle.

In an aspect of an embodiment of the present invention the undulating contour of the handle's outer rim may have an alternating concave-convex contour. In one aspect of an embodiment of the present invention the undulating contour of the outer rim of the handle may be concave about an arc of the cylindrical aperture(s) and convex elsewhere.

In an aspect of an embodiment of the present invention, portions of the undulating contour of the outer rim may be adjacent each arc of the cylindrical aperture(s). In an aspect of an embodiment of the present invention the portions of the undulating contour may be correspondingly and respectively shaped with the arc of a cylindrical aperture(s) adjacent to the aforementioned respective portions.

In an aspect of an embodiment of the present invention, the shoulder may be contiguous with a portion of the handle.

In an aspect of an embodiment of the present invention, each of the cylindrical aperture(s) may be of equivalent radii.

In an aspect of an embodiment of the present invention, at least two of the cylindrical aperture(s) may be of equivalent radii.

In an aspect of an embodiment of the present invention, an arc of at least one of the cylindrical aperture(s) extends into the neck of the bottle.

In an aspect of an embodiment of the present invention, the handle may further include an upper rising portion and a lower rising portion where the upper rising portion may be contiguous with a portion of the neck proximate with the rim and where the lower rising portion may be contiguous with the body of the bottle.

In an aspect of an embodiment of the present invention, the stopper may include a top portion and a plug portion positioned below and connected to the top portion. The plug portion may be configured to fit into the opening of the rim, which would function to keep liquids within the void contiguously enclosed by the neck, shoulder and body of the bottle. In an aspect of an embodiment of the present invention, the top portion may include conical structure(s). In an aspect of an embodiment of the present invention, the plug portion may have a smaller radius than the top portion.

In an aspect of an embodiment of the present invention, each of the cylindrical aperture(s) may be sequentially positioned in positions located at a portion of the handle proximate (i.e., closest) to the rim down to a portion of the handle proximate to the body of the bottle.

In an aspect of an embodiment of the present invention, each of the cylindrical aperture(s) may be aligned sequentially along an arc.

In an aspect of an embodiment of the present invention, the body may be contiguous with one of the cylindrical aperture(s).

BRIEF DESCRIPTION OF THE DRAWINGS

Referring now to FIGS. 1-8, various views of a bottle 100 and stopper 118 are shown according to aspects of embodiments of the present invention. Bottle 100 may include: a neck 102, where neck 102 may include a rim 104 with an opening 106 which opens up to a continuous void 108. Bottle 100 may additionally include a handle 110, which, in turn may include cylindrical aperture(s) 112*a*-112*d*, a base

110*b*, (see, FIG. 2) and an outer rim 110*a* opposite said base 110*b*. In an aspect of an embodiment of the present invention, base 110*b* may be contiguous with neck 102. In an aspect of an embodiment of the present invention outer rim 110*a* may have an undulating contour. In addition, cylindrical aperture(s) 112*a*-112*d* may be located or positioned between said base 110*b* and said outer rim 110*a*. It should be noted that the positioning and number of cylindrical aperture(s) 112*a*-112*d* shown here are only meant to be illustrative and not limiting.

Figure 1:
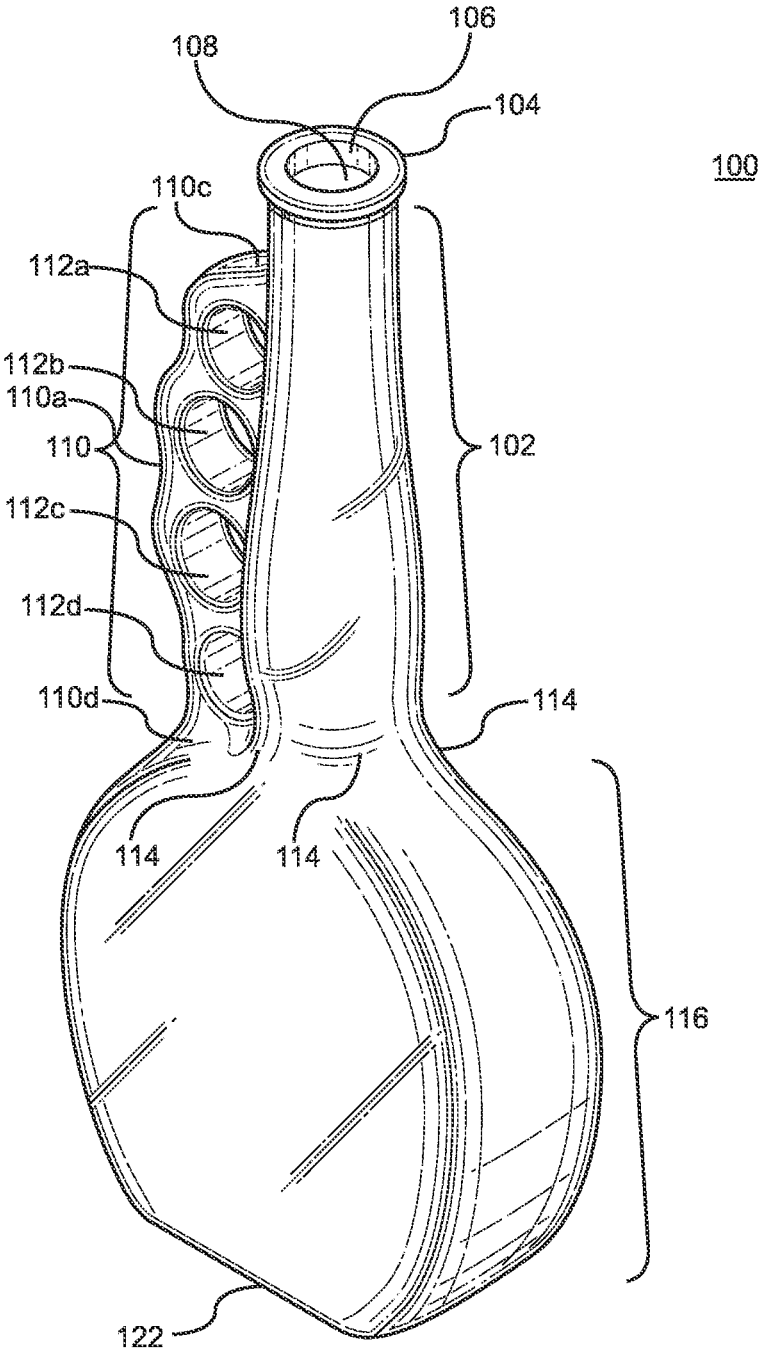
FIG. 1 illustrates a top perspective view of a bottle, according to an aspect of an embodiment of the present invention.
Figure 2:
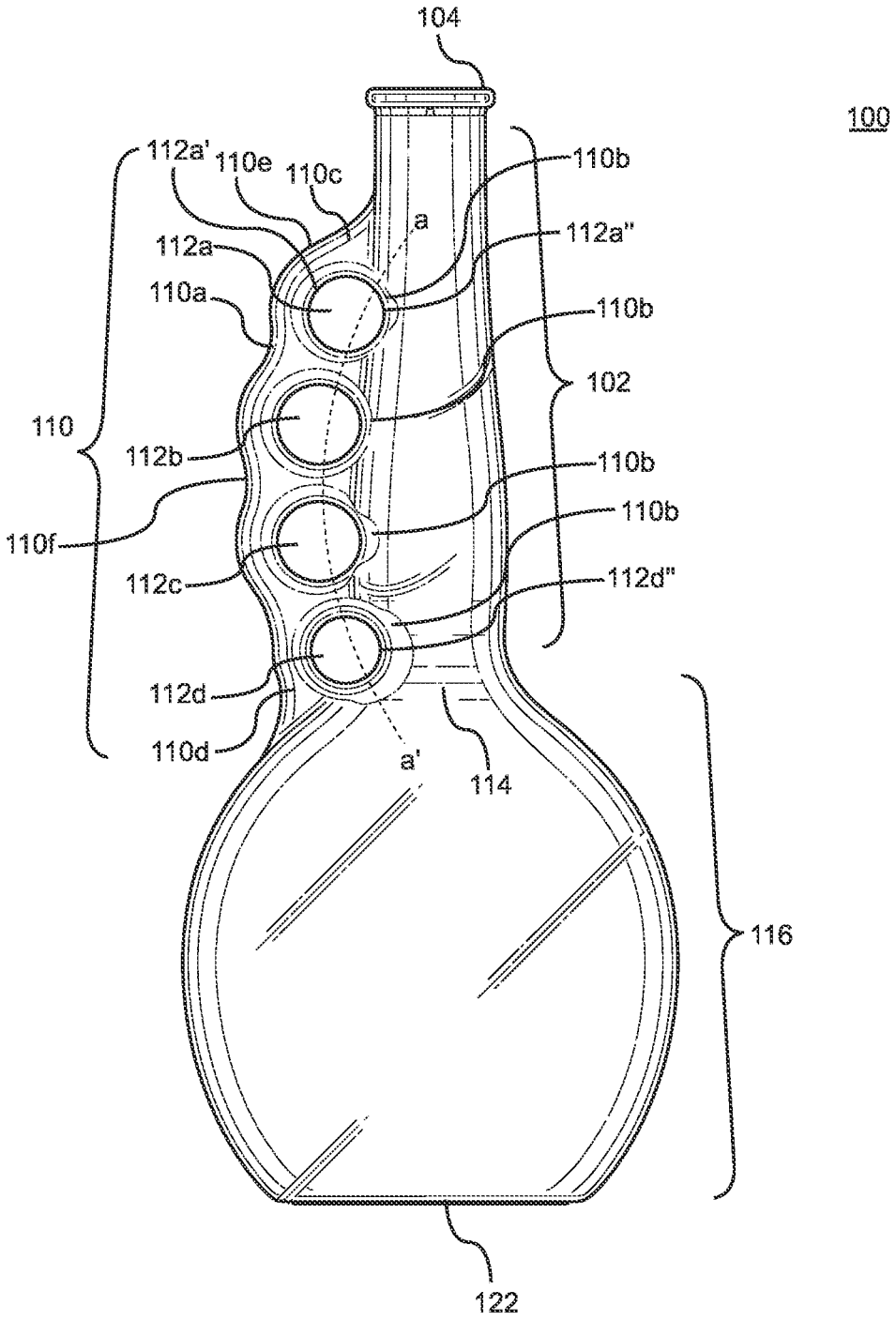
FIG. 2 illustrates a right-side view of a bottle, the left side being a mirror image thereof, according to an aspect of an embodiment of the present invention.
Figure 3:
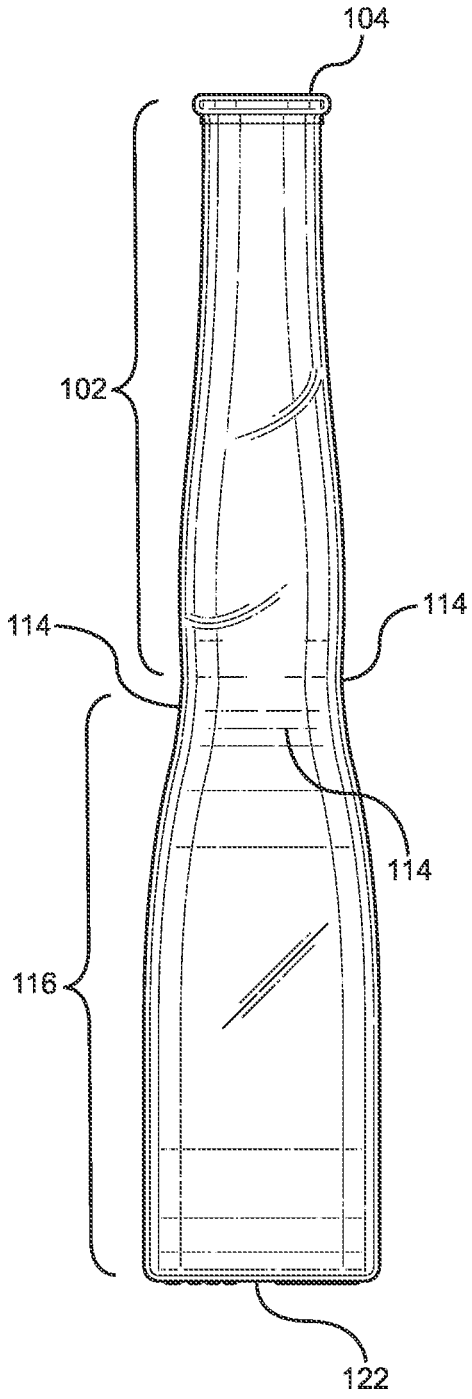
FIG. 3 is a front view of a bottle, according to an aspect of an embodiment of the present invention.
Figure 4:
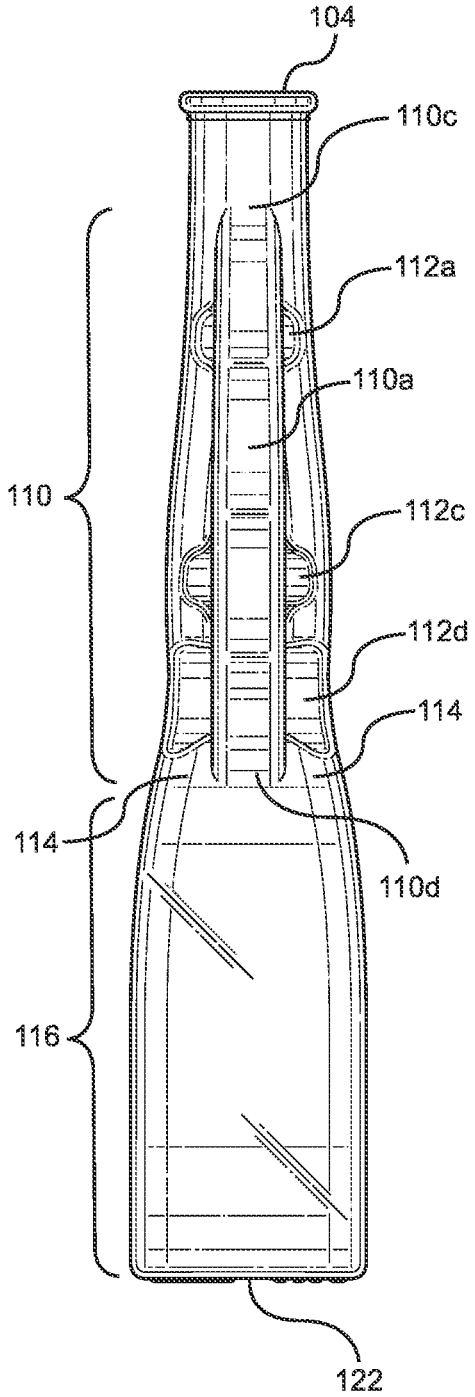
FIG. 4 is a rear view of a bottle, according to an aspect of an embodiment of the present invention.
Figure 5:
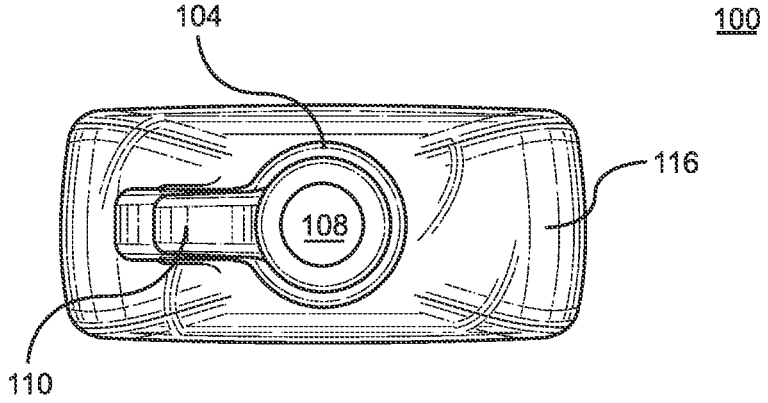
FIG. 5 is a top view of a bottle, according to an aspect of an embodiment of the present invention.
Figure 6:
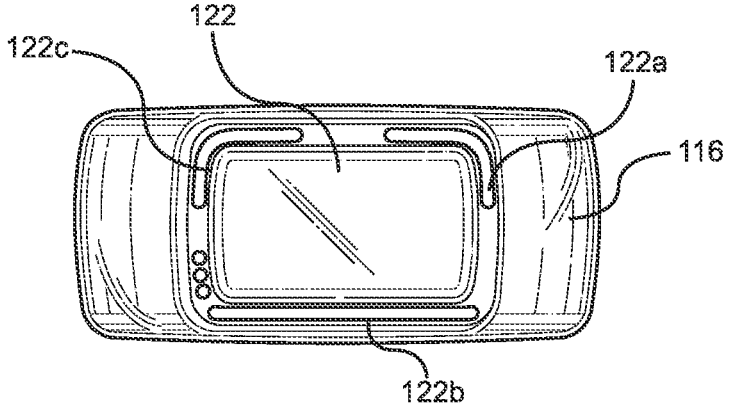
FIG. 6 is a bottom view of a bottle, according to an aspect of an embodiment of the present invention.

As shown in FIGS. 1, 2 and 4, cylindrical aperture(s) 112*a*-112*d* may, according to an aspect of an embodiment of the present invention, be sequentially positioned along handle 110 starting from an upper rising portion 110*c* of handle 110 proximate to said rim 104 down to a portion 110*d* of handle 110 proximate body 116. In an aspect of an embodiment of the present invention, each of cylindrical aperture(s) i.e., first cylindrical aperture 112*a*, second cylindrical aperture 112*b*, third cylindrical aperture 112*c* and fourth cylindrical aperture 112*d*, may be aligned sequentially along an arc a-a' (see, FIG. 2). While not limited to this aspect, in an aspect of an embodiment of the present invention, the center of each of cylindrical aperture(s) 112*a*-112*d* may be centrally positioned along arc a-a'.

Referring now to FIGS. 1-5 & 8, various views of both bottle 100 and stopper 118 are shown according to aspects of embodiments of the present invention. As shown, bottle 100 may further include: a shoulder 114, where shoulder 114 may be contiguous with neck 102, a body 116, where body 116 may be contiguous with shoulder 114, and a stopper 118, where stopper 118 may be configured to fit within rim 104's opening 106, and where neck 102, shoulder 114 and body 116 together contiguously enclose continuous void 108. Bottle 100 may be characterized as having its top defined by rim 104 and its bottom defined by the base 122 of body 116. Base 122 may include non-slip element(s) 122*a*-122*c* which create friction between base 122 and a surface. Non-slip element(s) 122*a*-122*c* function to prevent bottle 100 from slipping. In an aspect of an embodiment of the present invention, base element(s) 122 may be made of rubber, silicone or other similar materials meant to increase friction between surfaces. As shown in FIGS. 1, 2, 4 and 5 body 116, in an aspect of an embodiment of the present invention, may be contiguous with one of cylindrical aperture(s) 112*a*-112*d*. It should be noted that the number and positioning of non-slip element(s) 122*a*-122*c* shown here are meant to be illustrative only and not limiting.

In an aspect of an embodiment of the present invention, base 110*b* of handle 110 may be perpendicular to neck 102. Handle 110's perpendicular alignment with neck 102 further enables a user's ability to lift and utilize the bottle.

In an aspect of an embodiment of the present invention, the undulating contour of outer rim 110*a* may be or have a concave-convex contour. In one aspect of an embodiment of the present invention, the undulating contour of outer rim 110*a* may be concave (see, for example, portion 110*e* of handle 110 in FIG. 2) about at least one arc 112*a*' of cylindrical aperture 112*a*-112*d* and convex in at least one instance (see, for example, portion 110*f* of handle 110 in FIG. 2). The examples of this contour configuration discussed here are only illustrative and not meant to be limiting.

In another aspect of an embodiment of the present invention, portions of undulating contour of outer rim 110*a* may be adjacent each arc of cylindrical aperture(s) 112*a*-112*d*. In such an aspect, portions of the undulating contour of outer rim 110*a* may be correspondingly shaped with the adjacent arc of cylindrical aperture(s) 112*a*-112*d* (see, for example, portion 110*e* of handle portion 110).

In an aspect of an embodiment of the present invention, shoulder 114 may be contiguous with a portion of handle 110. In another aspect of an embodiment of the present invention, shoulder 114 may include portions that are contiguous with neck 102 as shown in FIGS. 1-3 and 5.

In an aspect of an embodiment of the present invention, each of cylindrical aperture(s) 112*a*-112*d* are of equivalent radii. In another aspect of an embodiment of the present invention, at least two of cylindrical aperture(s) 112*a*-112*d* are of equivalent radii. IN another aspect of an embodiment of the present invention, cylindrical apertures 112*a*-112*d* may all have different radii. The fenestrations of cylindrical aperture(s) 112*a*-112*d* enable a user to insert their fingers whilst using or lifting bottle 100. As such, aspects of embodiments of the present invention contemplate radii of cylindrical aperture(s) 112*a*-112*d* to be large enough to accommodate different user finger sizes.

In an aspect of an embodiment of the present invention, an arc of at least one of cylindrical aperture(s) 112*a*-112*d* may extend into neck 102 as shown in FIGS. 2 and 4. As an example, arc 112*a*" and 112*d*" are arcs of cylindrical apertures 112*a* and 112*d* which are shown to extend into neck 102 of bottle 100. Illustration of this feature is meant to be illustrative only and not limiting.

In an aspect of an embodiment of the present invention, handle 110 may further include an upper rising portion 110*c* and a lower rising portion 110*d* where upper rising portion 110C may be contiguous with a portion of neck 102 proximate with rim 104 and where lower rising portion 110*d* may be contiguous with body 116 and shoulder 114 all as shown in FIGS. 2 and 4. These rising portions 110*c* and 110*d* function to strengthen handle 110 and prevent breakage of same when bottle 100 is in use.

Figure 7A:
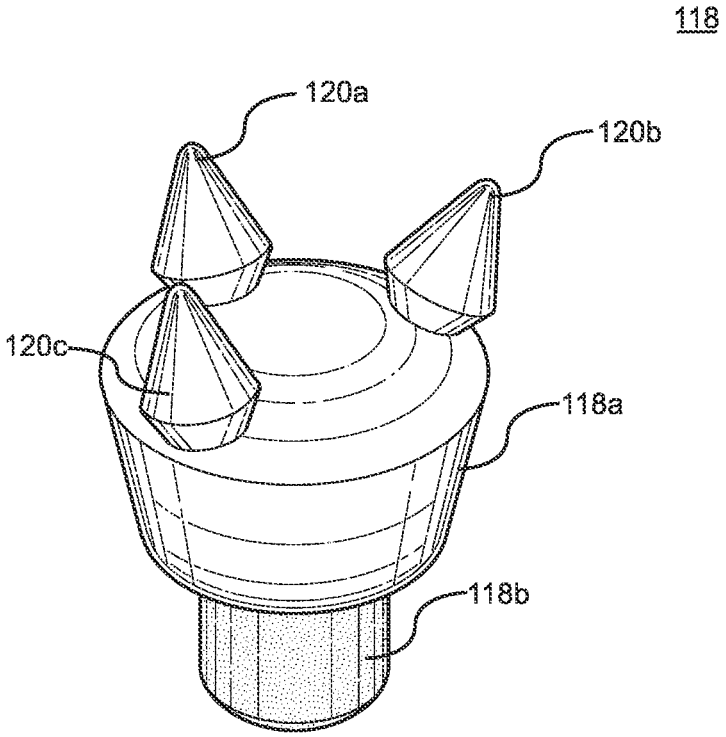
FIG. 7A is a top perspective view of a bottle stopper, according to an aspect of an embodiment of the present invention.
Figure 7B:
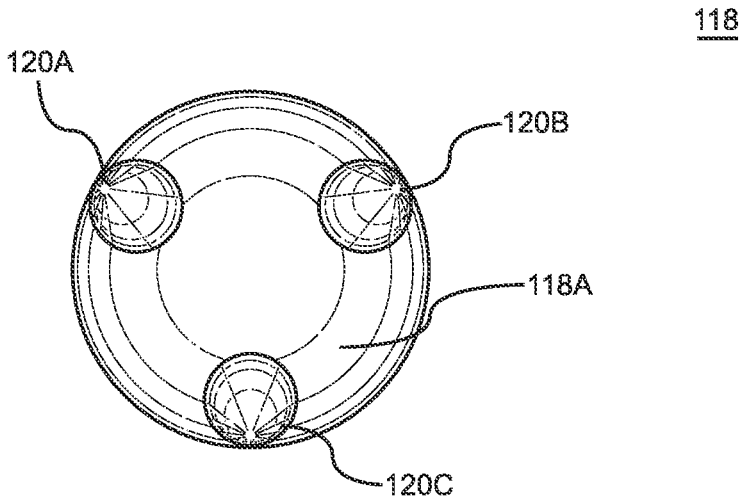
FIG. 7B is a top view of a bottle stopper, according to an aspect of an embodiment of the present invention.
Figure 7C:
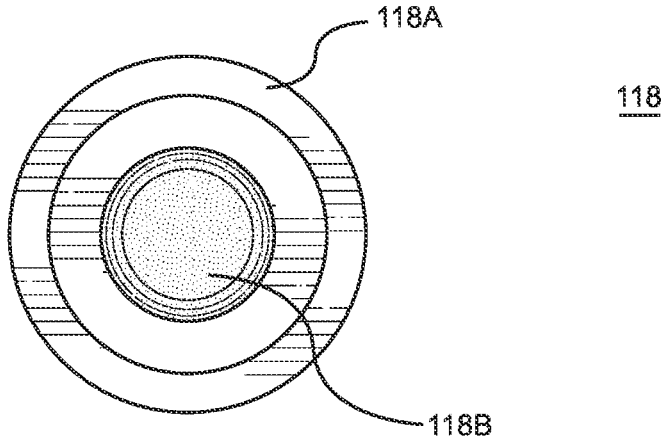
FIG. 7C is a bottom view of a bottle stopper, according to an aspect of an embodiment of the present invention.
Figure 8:
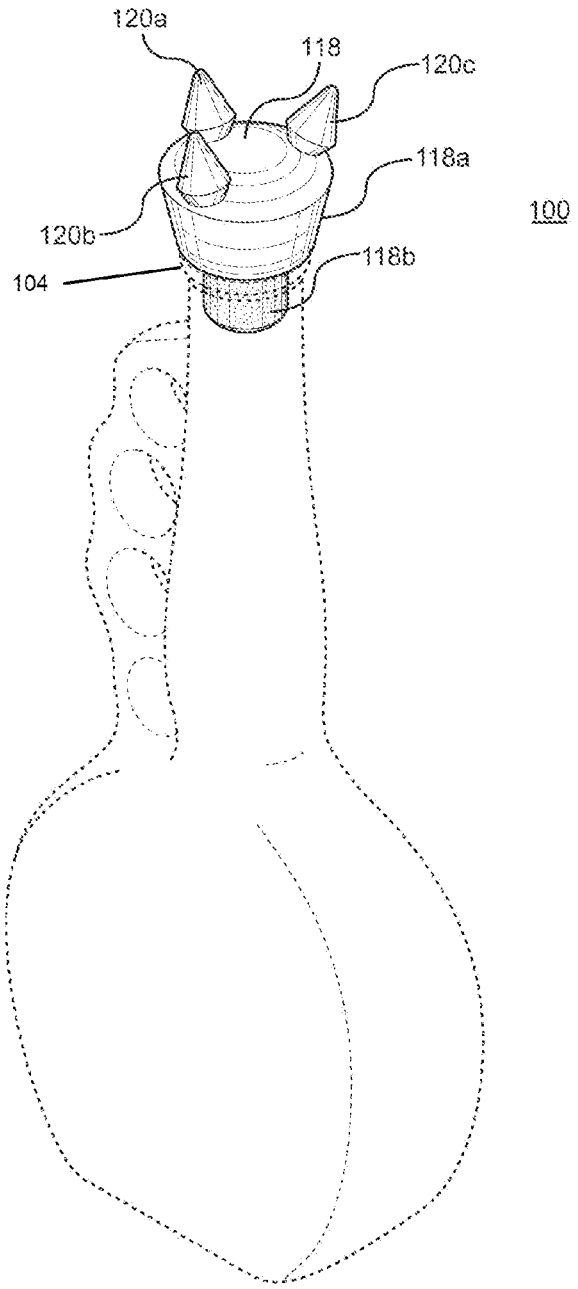
FIG. 8 is a top perspective view of a bottle stopper positioned within a bottle, according to an aspect of an embodiment of the present invention.

Referring now to FIGS. 7A-8, different views of stopper 118 are shown according to aspects of embodiments of the present invention. Bottle 100 may include stopper 118 which may include top portion 118*a* and plug portion 118*b*, where plug portion 118*b* may be connected to and positioned below top portion 118*a*. Plug portion 118*b* may be configured to fit into opening 106 of rim 104 (see FIG. 8). In an aspect of an embodiment of the present invention, plug portion 118*b* may have a smaller radius than the radius of top portion 118*a* as shown in FIGS. 7A and 7C.

In an aspect of an embodiment of the present invention, top portion 118*a* may include conical structure(s) 120*a*-120*c*. It should be noted that the number and positioning of conical structure(s) 120*a*-120*c* as shown here is only illustrative and not limiting.

Although this present invention has been disclosed with reference to specific forms and embodiments, it will be evident that a great number of variations may be made without departing from the present invention as outlined above, in the appended figures and in the claims presented below.

What is claimed is:

1. A bottle, comprising:

a neck, wherein the neck comprises of a rim with an opening to a void;

a handle, comprising: at least one cylindrical aperture, a base, and an outer rim opposite said base, wherein said base is contiguous with said neck and wherein said outer rim comprises of an undulating contour and wherein said at least one cylindrical aperture is located between said base and said outer rim;

a shoulder, wherein said shoulder is contiguous with said neck;

a body, wherein said body is contiguous with said shoulder; and a stopper, wherein said stopper is configured to fit within said rim's opening, wherein each of said neck, shoulder and body together contiguously enclose said void, wherein said handle is positioned adjacent said neck and above said body.

2. The bottle of claim 1, wherein said handle base is perpendicular to said neck.

3. The bottle of claim 1, wherein said undulating contour of said outer rim is a concave-convex contour.

4. The bottle of claim 3, wherein said undulating contour of said outer rim of said handle is concave about an arc of said at least one cylindrical aperture and convex elsewhere.

5. The bottle of claim 1, wherein portions of said undulating contour of said outer rim are adjacent each arc of said at least one cylindrical aperture.

6. The bottle of claim 5, wherein said portions of said undulating contour are correspondingly shaped with said adjacent arc of said at least one cylindrical aperture.

7. The bottle of claim 1, wherein said shoulder is contiguous with a portion of said handle.

8. The bottle of claim 1, wherein each of said at least one cylindrical aperture are of equivalent radii.

9. The bottle of claim 1, wherein at least two of said at least one cylindrical aperture are of equivalent radii.

10. The bottle of claim 1, wherein at least one arc of said at least one cylindrical aperture extends into said neck.

11. The bottle of claim 1, wherein said handle further comprises of an upper rising portion and a lower rising portion wherein said upper rising portion is contiguous with a portion of said neck proximate with said rim and wherein said lower rising portion is contiguous with said body.

12. The bottle of claim 1, wherein said stopper comprises of top portion and a plug portion positioned below and connected to said top portion, wherein said plug portion is configured to fit into said opening of said rim.

13. The bottle of claim 12, wherein said top portion comprises of at least one conical structure.

14. The bottle of claim 12, wherein said plug portion has a smaller radius than said top portion.

15. The bottle of claim 1, wherein each of said at least one cylindrical aperture is sequentially positioned starting from a portion of said handle proximate to said rim down to said body.

16. The bottle of claim 1, wherein each of said at least one cylindrical aperture is aligned sequentially along an arc.

17. The bottle of claim 1, wherein said body is contiguous with one of said at least one cylindrical aperture.

* * * * *